US008459606B1

(12) United States Patent
Gaspar et al.

(10) Patent No.: US 8,459,606 B1
(45) Date of Patent: Jun. 11, 2013

(54) DISPLAY MAGNETIC HANGER SYSTEM

(76) Inventors: Tony Gaspar, Templeton, CA (US); Todd Evenson, Paso Robles, CA (US); Gregory Powell, Paso Robles, CA (US)

( * ) Notice: Subject to any disclaimer, the term of this patent is extended or adjusted under 35 U.S.C. 154(b) by 265 days.

(21) Appl. No.: 12/843,831

(22) Filed: Jul. 26, 2010

Related U.S. Application Data

(60) Provisional application No. 61/228,553, filed on Jul. 25, 2009.

(51) Int. Cl.
*A47G 1/16* (2006.01)
*A47F 1/14* (2006.01)

(52) U.S. Cl.
USPC ..... 248/475.1; 248/467; 248/489; 248/497; 362/398

(58) Field of Classification Search
USPC ..... 248/206.5, 309.4, 467, 475.1, 915, 248/544, 511, 489–493, 497–498, 205.1, 248/477, 547, 683; 362/249.1, 396, 398, 362/382, 145
See application file for complete search history.

(56) References Cited

U.S. PATENT DOCUMENTS

| | | | | |
|---|---|---|---|---|
| 3,275,818 | A | 8/1964 | Campbell | |
| 3,970,837 | A | 7/1976 | Helm | |
| D340,846 | S | 11/1993 | Nichols, Jr. | |
| D346,950 | S | 5/1994 | Dunn et al. | |
| 5,311,414 | A | 5/1994 | Branham, Sr. | |
| 5,518,214 | A | 5/1996 | Spencer | |
| 5,803,577 | A | 9/1998 | Stratton | |
| 5,873,651 | A | 2/1999 | Hofer et al. | |
| D453,097 | S | 1/2002 | Goodwin | |
| 6,338,460 | B1 | 1/2002 | Rumpel | |
| 6,491,271 | B1 | 12/2002 | Adams | |
| 6,672,551 | B2 | 1/2004 | Rivellino et al. | |
| 6,855,890 | B1 | 2/2005 | Vasichek | |
| 6,918,680 | B2 | 7/2005 | Seeberger | |
| 7,066,618 | B1 | 6/2006 | Little | |
| 7,121,698 | B1 | 10/2006 | Johnson | |
| 7,188,977 | B1 | 3/2007 | Lough | |
| 7,226,370 | B1 * | 6/2007 | Cope | 473/406 |
| D547,146 | S | 7/2007 | Fetherston | |
| 7,914,185 | B2 * | 3/2011 | Moore | 362/398 |
| 7,997,773 | B2 * | 8/2011 | Kraus et al. | 362/396 |
| 2005/0023849 | A1 * | 2/2005 | Ganter | 294/19.1 |
| 2005/0269278 | A1 * | 12/2005 | Gipson | 211/86.01 |
| 2008/0078916 | A1 * | 4/2008 | Nevers et al. | 248/475.1 |
| 2009/0194662 | A1 * | 8/2009 | Urrutia | 248/544 |

* cited by examiner

*Primary Examiner* — Tan Le
(74) *Attorney, Agent, or Firm* — William Keyworth; Bill & Mary Lou Inc.

(57) ABSTRACT

A display magnetic hanger system provides a hanger support that may be repeatedly attached and removed at desired locations on a structure using a remote installation tool to install the hanger support and to install items for display on the hanger support. The installation of the hanger support is to a pre-installed magnet location marker at the desired location(s) on a structure. The desired location may be out of reach of the user desiring to display an item but the system and display item is easily installed using the long-handled remote installation tool.

4 Claims, 5 Drawing Sheets

DISPLAY MAGNETIC HANGER SYSTEM

CROSS-REFERENCE TO RELATED APPLICATIONS

This application claims the benefit of priority from Provisional Patent Application No. 61/228,553 filed on Jul. 25, 2009, which is incorporated herein by reference in its entirety.

STATEMENT REGARDING FEDERALLY SPONSORED RESEARCH AND DEVELOPMENT

Not Applicable.

BACKGROUND OF THE INVENTION

1. Field of the Invention

The display magnetic hanger system relates to a set of devices and a method where a magnet location marker device is repeatedly attached at desired locations on a structures vertical or near-vertical surface, then using a remote installation tool hanger supports are installed which then can be used to support display items which have a connected wire. The term wire is used in this application to mean a wire, cord, or other similar material used to connect devices. The wire is supported on the hanger support to provide for display of the item. The set of devices can include multiple magnetic location markers, multiple hanger supports with a ferro-magnetic material insert, and the remote installation tool. The desired locations may be out of reach of the user desiring to display an item, but once the location markers are installed, the hanger supports are easily installed or removed using the remote installation tool.

2. Description of Related Art

Hanger supports using magnetic force for supporting display items are described in U.S. Patent D346,950, U.S. Pat. No. 3,275,818 (Campbell), U.S. Pat. No. 5,873,651 (Hofer et al.), U.S. Pat. No. 6,520,661 (Hill), and U.S. Pat. No. 6,855,890 (Vasichek). A tool for use in hanging a string of Christmas tree lights is shown in U.S. Patent D453,097 (Goodwin).

SUMMARY OF THE INVENTION

The display magnetic hanger system is a set of devices including a magnet location marker, a hanger support with a ferro-magnetic material insert, and a remote installation tool for supporting and displaying one or more items with a connected wire. One or more magnet location markers have a front side, a rear side substantially parallel to the front side, an installation opening between the front and rear sides, and a peripheral surface of a desired size and shape that is parallel to the installation opening. The magnet location marker is installed with the installation-opening axis normal to the structure surface at the location(s) on a structure desired to display items.

The hanger support assemblies have a hanger portion with a top end with a magnet location marker support arranged to engage the upper edge of the peripheral surface of a magnet location marker, and a ferro-magnetic material insert support with a recessed surface surrounded by a second surface substantially normal to the recessed surface and arranged in a desired shape to fit a ferro-magnetic material insert within the recess which magnetically engages with the magnetic location marker to retain the position of the hanger support; and a bottom end with an item support hook adjacent to an installation tool mating configuration of the bottom end. The hook extends from the bottom end toward the top end and has a top end approximately at the midpoint between the hanger support top and bottom ends, which is below the insert support. The configuration of the hook provides a constricted passageway for installation of the wire until the wire is in the item support opening.

The ferro-magnetic material insert has a front side and a rear side substantially parallel to the front side and a periphery surface arranged in a desired shape normal to the front and rear sides, the periphery surface is further arranged to fit in and be attached to the hanger portion insert support such that the installed ferro-magnetic material insert is engaged with the hanger portion insert support.

The hanger support ferro-magnetic material insert magnetically engages a magnet location marker, and the magnet location marker support is arranged to support the hanger support on the magnet location marker peripheral surface, such that the magnet location marker support provides support of the hanger support assembly in the plane of the structure surface and the magnetic location marker support is substantially normal to the ferro-magnetic material insert rear side with the ferro-magnetic material insert installed in the hanger support assembly ferro-magnetic material insert support so the magnet and ferro-magnetic material insert surfaces are substantially parallel and magnetically retain the hanger support on the magnet location marker.

The installation tool mating configuration of the hanger support lower end is a left mating surface located between the front and rear sides and a right mating surface located between the front and rear sides and substantially normal to the sides. These left and right mating surfaces have a front mating surface and a rear mating surface.

The installation tool has a shaft with a hanger support assembly installation end and a display item installation end. The hanger support assembly installation end is arranged with a front side with a cutout extending from the display item installation end to a cutout end located a predetermined distance from the hanger support assembly installation end, a rear side, and left and right sides and a substantially rectangular shaped opening at the end extending beyond the cutout end. The cutout and opening are further arranged such that a hanger support assembly is removably insertable in the opening with the item support hook located in the cutout. The display item installation end has a first manipulating finger extending beyond the shaft installation end and a second manipulating finger extending beyond the shaft installation end, each finger arranged at an opposing angle from the other finger. The angle of each finger is less than 45 degrees from the shaft axis.

OBJECTS AND ADVANTAGES

One advantage of the present invention is to provide one or more display hangers that may be removably installed in the same location(s) on a structures vertical or near-vertical surface.

A second advantage of the present invention is to provide a display hanger that may be installed and removed remote from the installation location.

A third advantage of the present invention is to provide a display hanger system that includes a dual-purpose tool for hanger installation and removal and display installation and removal.

A fourth advantage of the present invention is to provide a display hanger system that may be hidden from normal view when not in use and minimally in view when in use.

BRIEF DESCRIPTION OF THE SEVERAL VIEWS OF THE DRAWINGS

A more complete understanding of the present invention can be obtained by considering the detailed description in conjunction with the accompanying drawings, in which.

REFERENCE NUMERALS IN DRAWINGS

Figure 1:
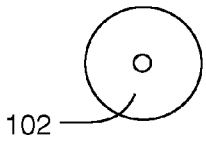
FIG. 1 is a front view of a magnet location marker.

These reference numbers are used in the drawings to refer to areas or features of the invention.

102 magnet location marker
114 hanger support
116 ferro-magnetic material insert
118 hook
120 insert support
122 location marker support
124 item installation gap
126 item support opening
128 removal tab
130 installation mating end
140 remote installation tool
142 installation tool hanger support assembly installation end
144 installation end mating support
146 installation end hook support
148 installation tool display item installation end
150 installation end finger
152 installation tool shaft
160 structure
170 fastener
180 display item

DETAILED DESCRIPTION OF THE INVENTION

Figure 2:
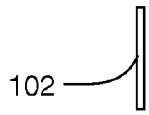
FIG. 2 is a left side view of a magnet location marker.
Figure 3:
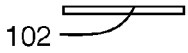
FIG. 3 is a top view of a magnet location marker.
Figure 4:
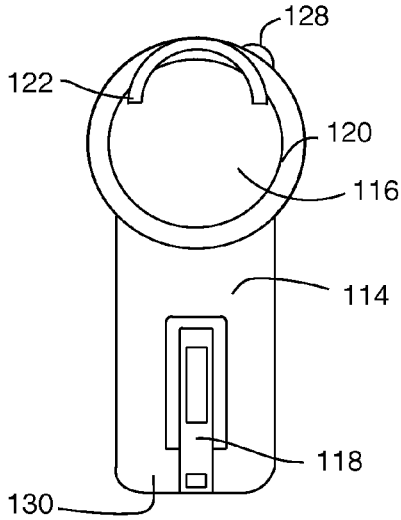
FIG. 4 is a front view of a hanger support with a ferro-magnetic material insert.
Figure 9:
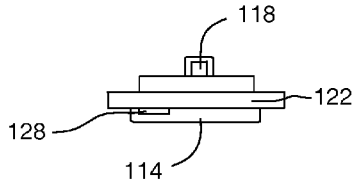
FIG. 9 is a top view of a hanger support.
Figure 15:
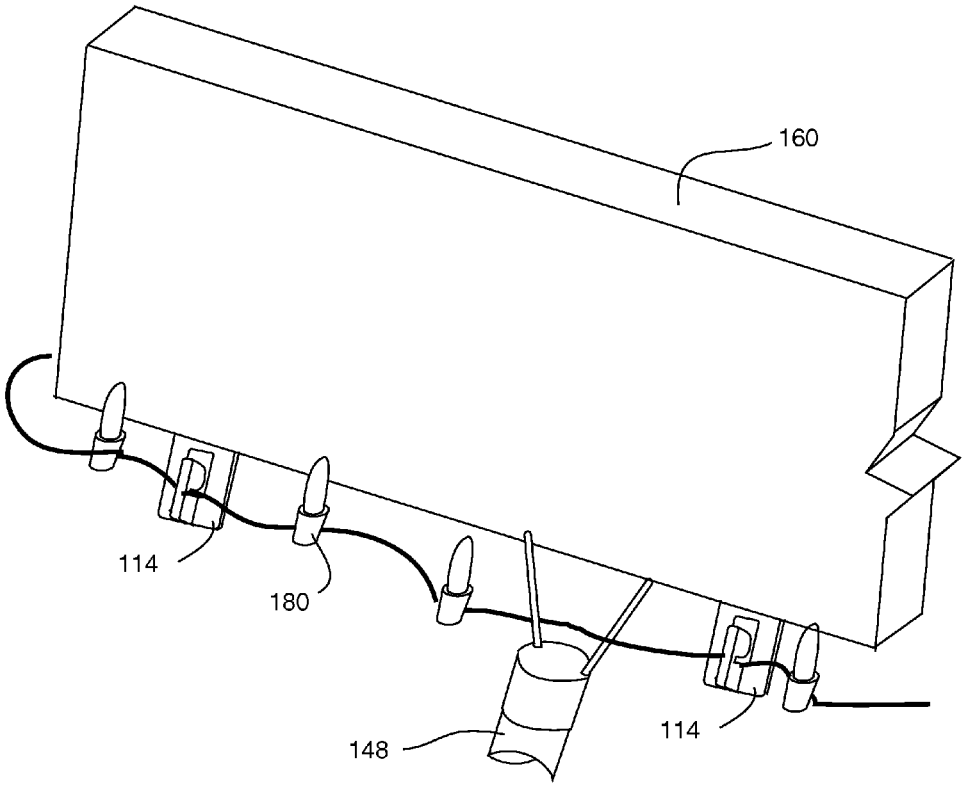
FIG. 15 is a perspective view of a remote installation tool with the display item installation end engaged with a display item that is in process of installation on multiple hanger support assemblies installed on the back side of a structure member.
Figure 16:
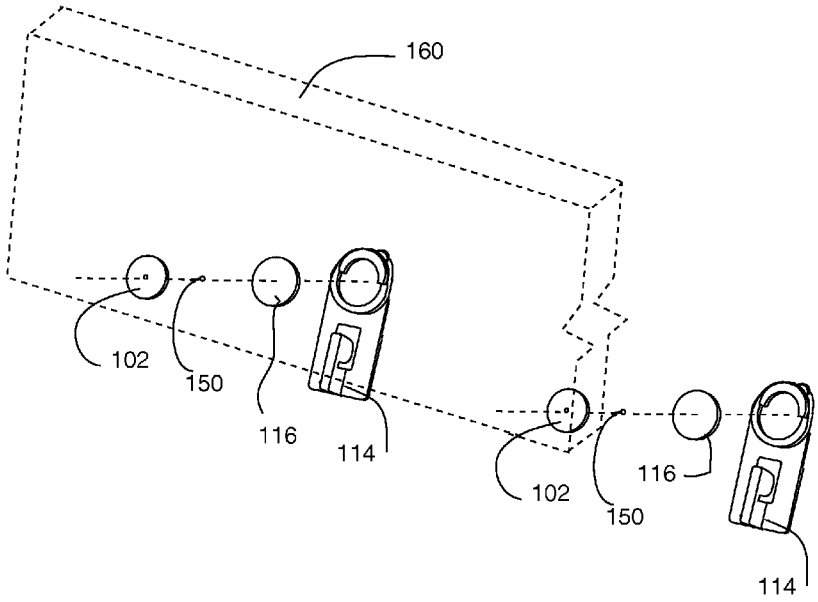
FIG. 16 is an exploded view of a hanger support and magnetic location marker showing the parts and assembly to install a hanger support on a magnetic location marker on the back side of a structure. The structure is shown in broken lines to show the parts behind the structure.

The display magnetic hanger system set of devices to support items for display includes a magnet location marker (102), shown in FIGS. 1 through 3 and 16, a hanger support (114) with a ferro-magnetic material insert (116), shown in FIGS. 4, through 9 and 16, and a remote installation tool (140) shown in FIGS. 10 through 15.

The magnet location marker (102) is a substantially round magnet with a front and back surface with an opening that provides the means for attachment to a structure vertical or near-vertical surface between the surfaces as illustrated in FIG. 1. Side and top views of the marker are in FIGS. 2 and 3 and show a substantially flat peripheral surface, although this contour may be convex. FIG. 16 shows the installation of a magnet location marker (102) on a structure (160) vertical or near-vertical surface, using a fastener (150). The magnet location marker (102) fastened to the structure is a locater that provides the means for positioning and supporting the hanger support.

Figure 5:
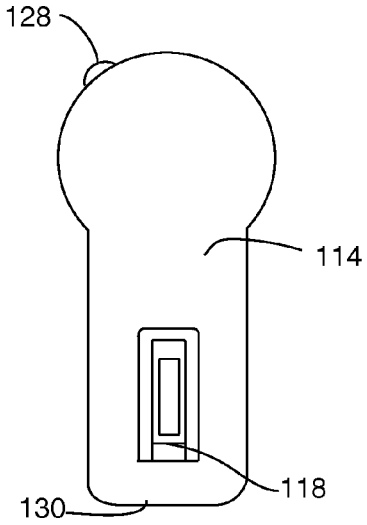
FIG. 5 is a rear view of a hanger support.

The hanger support (114) is a molded device with the location marker support (122) molded on the front side top end and with an insert support (120) also molded on the front side top end as shown in FIG. 4. The location marker support (122) is contoured to mate with the shape and size of the magnet location marker peripheral surface and assists in support of the hanger support (114) on a magnet location marker (102) by supporting its weight on the peripheral surface of the magnet location marker (102), which is shown in FIGS. 1 through 3. Near the bottom, that is the installation mating end (130) of the hanger support (114) back side, is a hook (118) curving from the back side surface adjacent to the installation mating end (130) towards the top end. The display items (180) in FIG. 15 are mounted on a wire such that supporting the wire at one or more locations by hanger supports (114) will support the display item (180). A removal tab (128) may be provided near the hanger support (114) top end to provide a surface for moving the hanger support (114) away from an attached magnet location marker (102) for removal. The insert support (120) is a raised surface on the hanger support front side surface arranged to form an opening for placement of a ferro-magnetic material insert (116) into the opening formed by the insert support (120), as shown in FIG. 5. The insert (116) may be attached either by an interference fit with the insert support, or by attachment with an adhesive, The ferro-magnetic material insert (116) is attracted by the magnetic force of the magnet location marker (102) which supports the hanger support (114). The magnetic coupling is between the two substantially flat surfaces of the insert (116) and the marker (102) as illustrated in FIG. 16.

Figure 6:
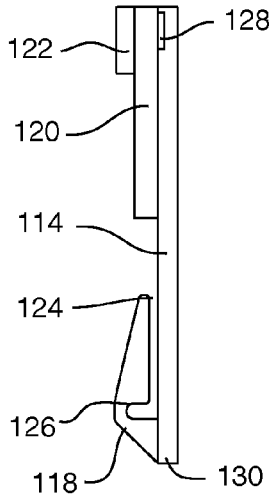
FIG. 6 is a left side view of a hanger support.
Figure 7:
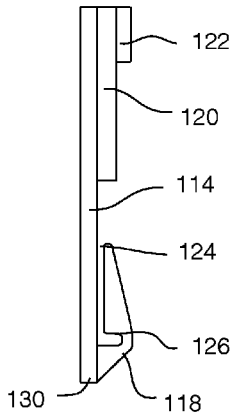
FIG. 7 is a right side view of a hanger support.
Figure 8:
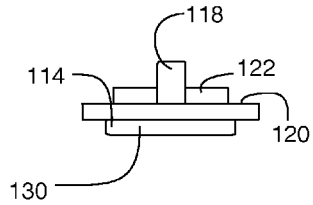
FIG. 8 is a bottom view of a hanger support.

The hook (118) of the hanger support (114) is arranged with its base joined to the installation mating end (130) of the hanger support (114) and extending to substantially the midpoint of the hanger support between the top and bottom ends, as shown in FIGS. 4 through 7. The hook is located below the insert support to allow access to the hook when the hanger support is installed. The hook (118) is configured to form an item installation gap (124) with an upper and lower end, the upper end with a chamfered entry between the inner surface of the hook and the back side surface of the hanger support (114). Near or at the base of this installation gap (124), as shown in FIGS. 6 and 7, is an item support opening (126). This gap provides a retention location for the display item wire. The retention gap provides a restricted passage for installation of the item wire. Once the wire has traversed the installation gap (124), it will rest in the item support opening (126). Removal of the wire then requires application of force to move the wire into and up the installation gap (124). The hanger support (114) is the means for supporting and retaining the display items.

Figure 12:
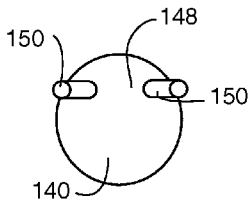
FIG. 12 is a display item installation end view of a remote installation tool.
Figure 13:
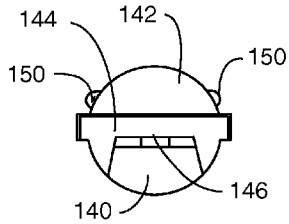
FIG. 13 is a hanger support assembly installation end view of a remote installation tool.
Figure 14:
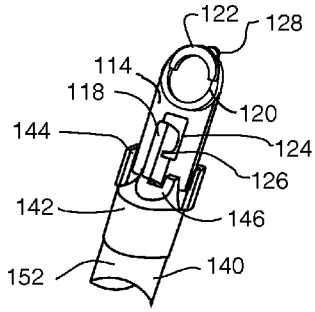
FIG. 14 is a perspective view of a remote installation tool with the hanger support assembly installation end engaged with a hanger support.

The remote installation tool (140) has a long shaft (152) with a hanger support assembly installation end (142) and a display item installation end (148). The shaft (152) is shown cutaway in FIGS. 10 and 11. FIGS. 12 and 13 show end views of the hanger support assembly installation end (142) and the display item installation end (148) respectively.

The installation tool hanger support assembly installation end (142) is arranged with an installation end mating support (144) and a installation end hook support (146) that are configured to engage and support the hanger support (114) installation mating end (130) as shown in FIGS. 10, 11, 13, and 14. Using this end with a hanger support (114) engaged, the hanger support may be lifted to a desired location on a structure (140) within the range of the installation tool shaft (152) and attached to an existing magnet location marker (102) on the structure.

Figure 10:
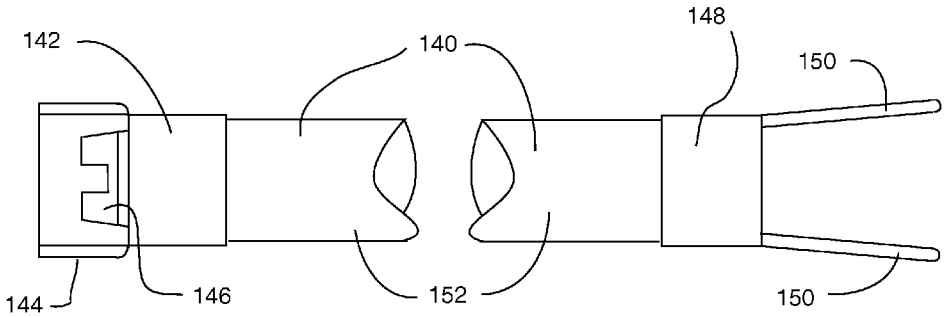
FIG. 10 is a front view of a remote installation tool. The shaft of the tool is cut-away to enable fitting the drawing on the sheet.
Figure 11:
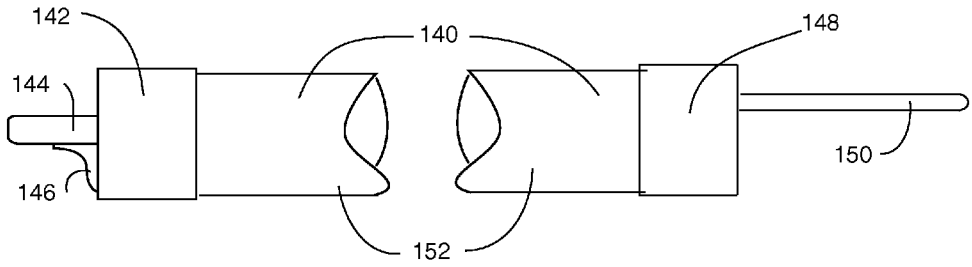
FIG. 11 is a left side view of a remote installation tool. The shaft of the tool is cut-away to enable fitting the drawing on the sheet.

The installation tool display item installation end (148) is configured with end fingers (130) arranged at an angle to each other to form a V-shaped working area between the end fingers as shown in FIGS. 10, 11, and 15. This configuration allows the tool to support the display item wire and allow lifting it to a hanger support (114) installed on a magnet location marker (102) on the structure for installation on the hanger support. FIG. 15 shows two hanger supports (114) with the display items (180) wire installed. The installation tool is the means for locating the hanger support and the means for locating the display items on the hanger support.

OPERATION

The use of the display magnetic hanger system set of devices to support display items on a wire uses the following method of installation. This method describes use for multiple display items connected by wires. The method is similar for a single display item with a wire used to hang the item. In this latter case one or two magnetic hanger system sets suffice to support the display item. First, one or more magnetic location markers (102) are first installed in desired locations on the surface of a structure member near the bottom of the member using common fasteners, as indicated by FIG. 16. The opening in the magnetic location markers (102) provide the means for attachment to a structure. The use of a surface on the back side of the structural member is preferred as this places the magnet location markers (102) out of sight and faces the hook towards the front of the structure. They are placed near the bottom so in the preferred arrangement the hook portion of the hanger supports (114) is accessible by location below the structural member, and is the only portion visible when hung on the location marker. The hanger supports (114) may then be engaged with the installation tool hanger support assembly installation end (142) and magnetically attached to the magnetic location markers (102), where they are supported by the magnetic attraction between the magnet location marker (102) and the hanger support (114) insert (116), and mechanically supported by the location marker support (122) portion of the hanger support (114) as illustrated by FIG. 15. This is repeated until all the desired locations have a hanger support (114) installed. Then the display item may be installed in a linear sequence using the installation tool display item installation end (148) to lift the display item by its attached wire and place the wire at the first hanger support (114) hanger support hook (118) item installation gap (124). The side of a display item installation end (148) finger (150) is then used to move the display item wire down the item installation gap (124) until the wire is resting in the item support opening (126), thus engaging the hanger support. This is repeated for each of the hanger supports (114) until all are engaged with the display item wire.

Removal of the display item is the reverse of this method. First the display item (180) wire is lifted into and along the first hanger support hanger support hook item installation gap (124) until the wire is disengaged from the hanger support. This is repeated for each of the hanger supports (114) in sequence until the entire display item has been disengaged. If another display item is to be installed, it may be done using the process already given. If there are no further display items to hang, the hanger supports (114) may be removed for storage by engaging them, one at a time, with the installation tool hanger support assembly installation end (142), lifting them slightly and moving them to an angle with the ferro-magnetic material location marker (102) to free them from the marker.

We claim:

1. A system for removable support of a display item wire on a structure near-vertical surface comprising:

a. one or more location markers and one or more hanger supports;

b. the location markers arranged with a front and rear surface with means for attachment to a structure and a substantially round circumference between the surfaces;

c. the hanger supports arranged with a top end and a bottom end and a front side surface and a back side surface;

d. a location marker support located on the hanger support front side top end and arranged to support the hanger support on the location marker circumference;

e. an insert support also located on the hanger support front side top end and arranged with a raised surface extending from the front side surface forming an opening;

f. a ferro-magnetic material insert arranged to fit within the opening formed by the insert recess; and g. a hook with a bottom end extending from the hanger support back side bottom end and extending to a top end located below the insert support, the hook arranged to form an item installation gap between a hook inner surface and the hanger support back side surface, with an item support opening at the bottom end of the item installation gap, whereby installation of a location marker on a structure surface provides a locater for installation of a hanger support on the location marker that provides mechanical support of the hanger support assembly in the plane of the structure surface and magnetically affixes to the location marker through the hanger support, such that the hanger support hook provides a support means for a display item wire.

2. The system of claim 1 further comprising:

a. a remote installation tool with a shaft with a hanger support assembly installation end and a display item installation end, b. the hanger support assembly installation end arranged with an installation end mating support and a installation end hook support configured to engage and support the hanger support installation mating end; and c. the display item installation end is configured with two end fingers arranged at an angle to each other to form a V-shaped working area between the end fingers whereby a hanger support may be engaged with the hanger support assembly installation end to be moved near a magnetic location marker where it may be engaged with and supported by the magnetic location marker, and then the display item wire may be engaged with the display item installation end to be moved to the hanger support and engaged and supported by the hanger support hook.

3. A method of providing and installing a system of devices for support, installation, and removal of a display of items connected by a wire comprising:

a. forming a location marker arranged with a front and rear surface with means for attachment to a structure and a substantially round circumference between the surfaces; and b. forming a hanger support arranged with a top end and a bottom end and a front side surface and a back side surface, and with a location marker support located on the hanger support front side top end and arranged to support the hanger support on the location marker circumference and with an insert support also located on the hanger support front side top end and arranged with a raised surface extending from the front side surface forming an opening and a ferro-magnetic material insert arranged to fit within the opening formed by the insert recess and with a hook with a bottom end extending from the hanger support back side bottom end and extending to a top end located below the insert support, the hook arranged to form an item installation gap between the hook inner surface and the hanger support back side surface, with an item support opening at the bottom end of the item installation gap;

c. forming a remote installation tool with a shaft with a hanger support assembly installation end and a display item installation end;

d. arranging the hanger support assembly installation end with an installation end mating support and a installation end hook support configured to engage and support the hanger support installation mating end; and e. configuring the display item installation end with two end fingers arranged at an angle to each other to form a V-shaped working area between the end fingers;

f. installing one or more location markers and hanger supports; and g. installing the item on the hanger support using the remote installation tool.

4. A method of displaying items connected by a wire comprising:

a. installing one or more magnetic location markers in desired locations on a surface of a structure member;

b. engaging an installation tool hanger support assembly installation end with a hanger support arranged with a top end and a bottom end and a front side surface and a back side surface, and with a location marker support located on the hanger support front side top end and arranged to support the hanger support on the location marker circumference and with an insert support also located on the hanger support front side top end and arranged with a raised surface extending from the front side surface forming an opening and a ferro-magnetic material insert arranged to fit within the opening formed by the insert recess and with a hook with a bottom end extending from the hanger support back side bottom end and extending to a top end located below the insert support, the hook arranged to form an item installation gap between a hook inner surface and the hanger support back side surface, with an item support opening at the bottom end of the item installation gap;

c. moving the hanger support to the location of a magnetic location markers;

d. engaging the hanger support with the magnetic location markers magnetically and mechanically;

e. engaging the display item wire with an installation tool display item installation end;

f. moving the display item wire to the location of the hanger support; and g. engaging the display item wire with the hanger support hook.

* * * * *